US006954955B2

(12) United States Patent
Brewin et al.

(10) Patent No.: US 6,954,955 B2
(45) Date of Patent: Oct. 18, 2005

(54) INFANT SLEEP POSITIONER

(75) Inventors: Joseph F. Brewin, Franklin, MA (US); Antonio S. Fernandes, Fall River, MA (US); Bryan R. Hotaling, Acton, MA (US); Lawrence J. Salvo, Stow, MA (US)

(73) Assignee: The First Years Inc., Avon, MA (US)

( * ) Notice: Subject to any disclaimer, the term of this patent is extended or adjusted under 35 U.S.C. 154(b) by 0 days.

(21) Appl. No.: 10/459,128

(22) Filed: Jun. 10, 2003

(65) Prior Publication Data

US 2004/0250351 A1 Dec. 16, 2004

(51) Int. Cl.[7] ..... A47C 20/02
(52) U.S. Cl. ..... 5/655; 5/94; 5/95; 5/99.1
(58) Field of Search ..... 5/655, 94, 95, 5/99.1, 424, 503.1

(56) References Cited

U.S. PATENT DOCUMENTS 5,333,769 A * 8/1994 Skroski ..... 224/158
5,367,730 A 11/1994 Sher
5,379,469 A * 1/1995 Millis et al. ..... 5/95
5,383,711 A 1/1995 Houghteling
5,430,899 A * 7/1995 Chisholm ..... 5/95
5,713,090 A 2/1998 Rodgers
6,370,715 B1 * 4/2002 Morton ..... 5/655

* cited by examiner

*Primary Examiner*—Heather Shackelford
*Assistant Examiner*—Fredrick Conley
(74) *Attorney, Agent, or Firm*—Fish & Richardson P.C.

(57) ABSTRACT

A device for stabilizing the position of an infant while sleeping including a substantially rigid basin assembly having three sides and a base and defining an open end. A basin cover conforms generally to the basin and defines a sleep space, sized and configured for holding an infant, the cover includes a fabric outer surface and at least one of the sides of the basin assembly comprises a plurality of standoffs extending into the basin assembly and defining recesses therebetween. The cover can have an air-permeable section overlaying the recesses to enable pneumatic communication between the sleep space and the recesses.

15 Claims, 4 Drawing Sheets

INFANT SLEEP POSITIONER

TECHNICAL FIELD

This invention relates to a sleep positioner for holding an infant while sleeping.

BACKGROUND

Many parents elect to place their infants on adult beds for napping or sleeping. Research has demonstrated that infants who sleep with their parents (sometimes referred to as "co-sleeping") breastfeed more and receive more protective care and attention during the night, which can be beneficial to the developing child. When co-sleeping, however, parents must take special precautions to ensure the safety of the child such as to avoid possible entrapment of the infant between the bed and the wall or between the bed and headboard, and to limit the infant's contact with soft bedding materials.

A device is desired that can facilitate the advantages attendant to co-sleeping while reducing any associated risks and enhancing child comfort.

SUMMARY

According to one aspect of the invention, a device for stabilizing the position of an infant while sleeping includes a substantially rigid basin assembly having three sides and a base and defining an open end. A basin cover is provided conforming generally to the basin and defining a sleep space, sized and configured for holding an infant, the cover having a fabric outer surface; wherein at least one of the sides of the basin assembly comprises a plurality of standoffs extending into the basin assembly and defining recesses therebetween. The cover can include an air-permeable section overlaying the recesses to enable pneumatic communication between the sleep space and the recesses.

According to another aspect of the invention, a device for stabilizing the position of an infant while sleeping on an adult bed having a mattress and a foundation includes a substantially rigid basin assembly having three sides and a base and defining an opening, a basin cover having a fabric outer surface and conforming generally to the basin and defining a sleep space, sized and configured for holding an infant and an anchoring flap depending from a head end of the rigid basin, the flap being adapted for insertion between the bed and an adjacent surface for inhibiting movement of the device According to still another aspect of the invention, a device for stabilizing the position of an infant while sleeping includes a substantially rigid three-sided basin assembly defining an opening and being sized and configured for holding the infant, a planar base extending from the basin assembly, a perforated layer extending across the inside surface of the standoffs to prevent the infant from contacting the recesses along the sides of the basin assembly, a foam foot stop removably attached to a lower portion of the planar base; and left and right side netting walls extending from the basin assembly to the foot stop along both side of the planar base for providing supplemental security to the infant occupant.

In various embodiments according to the invention, the infant sleep positioner may include a foam foot stop removably attached to a lower portion of the base. In some embodiments, the invention is configured and adapted to be foldable into a stowed state. In one embodiment, the invention is includes at least one flap extending from a bottom edge of the planar base to cover the device in the stowed configuration. The inventions may includes a soft fabric shell covering the basin. The device may further include a night light integral molded to basin.

In some embodiments, the invention includes an adjustable positioning insert disposed within the sleep space and including two resilient members removably connected by an adjustable planar base, the planar base sized and dimensioned to span the width of the sleep space.

Accordingly, the above-described infant sleep positioner can provide a secure "sleep space" for infants on an adult bed for proximity to parents for access, feeding and care giving throughout the night. The air passages and recesses can enhance breathability and comfort, while the positioning flap can help to anchor the basin against movement.

The details of one or more embodiments of the invention are set forth in the accompanying drawings and the description below. Other features, objects, and advantages of the invention will be apparent from the description and drawings, and from the claims.

DESCRIPTION OF DRAWINGS

The invention is pointed out with particular reference in the appended claims. A fuller understanding of the natures and objects of the invention may be had be reference to the following illustrative descriptions and figures, when taken in conjunction with the accompanying claims.

Like reference symbols in the various drawings indicate like elements.

DETAILED DESCRIPTION

Figure 1:
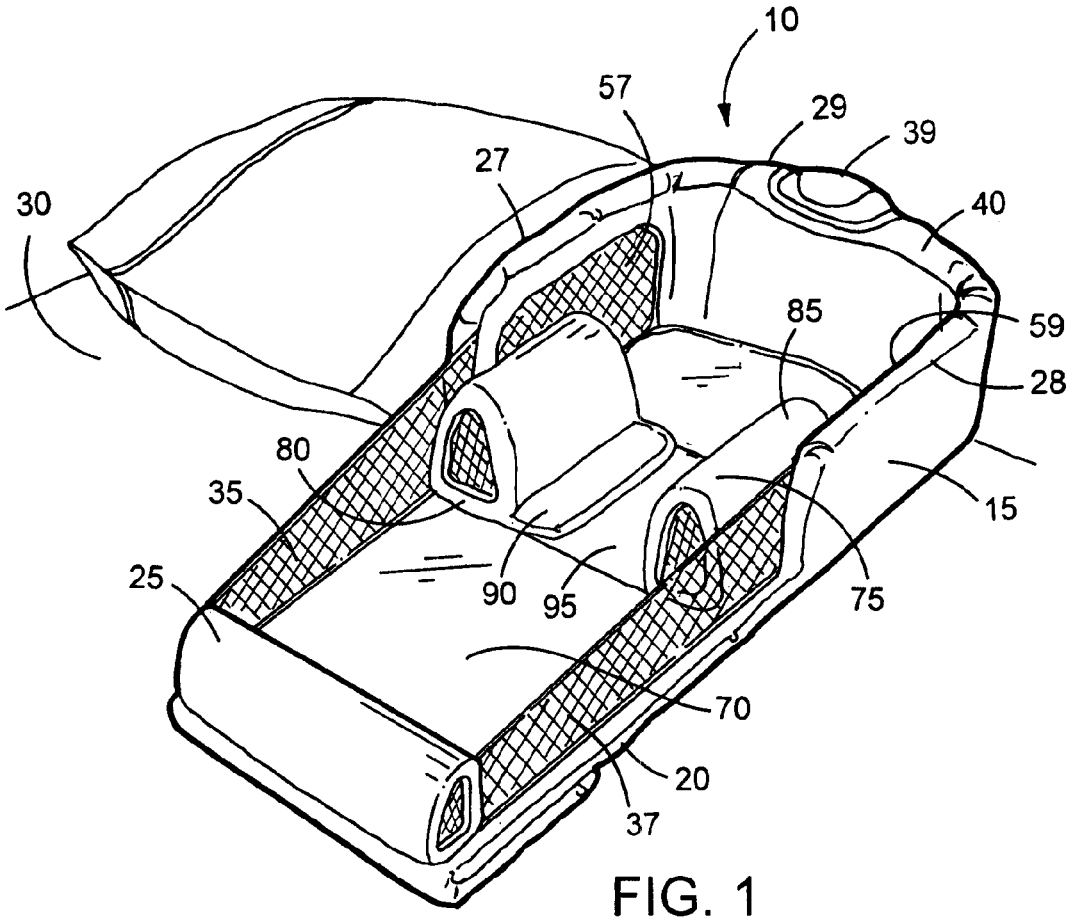
FIG. 1 is a perspective view of a infant sleep positioner, in an open position, according to the invention.

As shown in FIG. 1, the infant sleep positioner 10 generally includes a shell assembly 15, a base 20, and a foot stop 25. In one embodiment, the shell assembly 15 is a three-sided basin defining an opening and including a left wall 27, a right wall 28, and a back wall 29, each wall extending upwardly in a substantially vertical orientation. The positioner 10 is configured for placement and retention on a bed 30.

Figure 6:
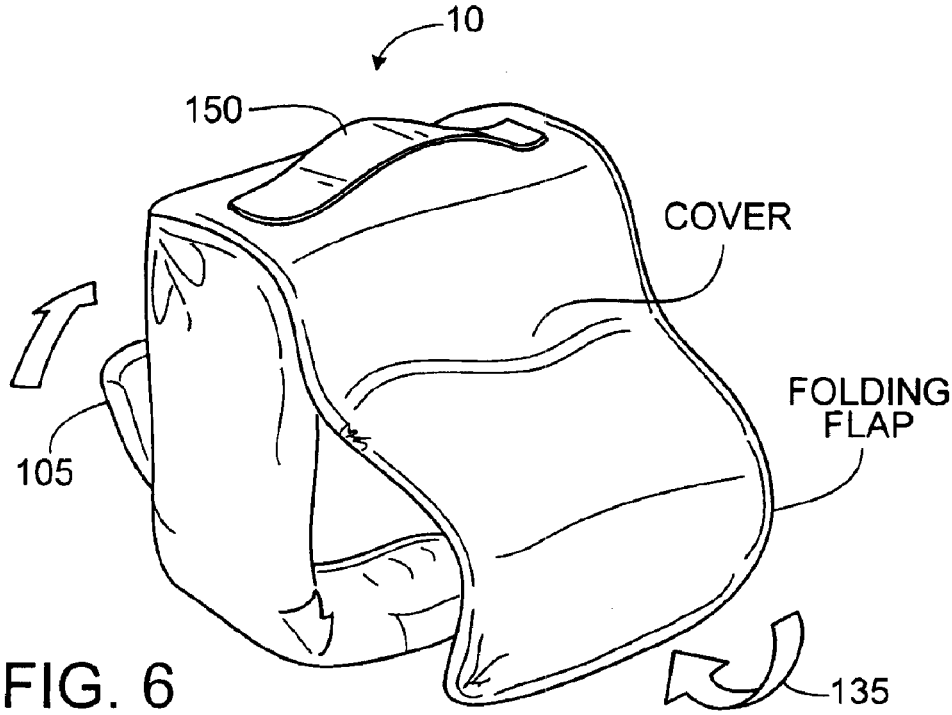
FIG. 6 is a perspective view of the infant sleep positioner of FIG. 1 in a stowed state.

In one embodiment, left and right side netting walls 35, 37 extend along the base 20 from the left and right walls 27, 28 of the shell assembly 15 to the foot stop 25. The netting walls 35, 37 can include an elastic cord threaded along the top seam of the mesh to keep the walls 35, 37 taught while permitting some deformation when a load is applied as well as folding the positioner 10 in a stowed state (FIG. 6). The walls 27, 28, 29 of the shell assembly 15, the left and right side netting walls 35, 37 and the foot stop 25 generally define the perimeter of a rectangular sleep space for the placement and protection of an infant 38. In one embodiment, the infant sleep positioner 10 includes a night light 39, including a battery holder, switch, bulb and lens, integrally mounted to a top portion of the back wall 29 of the shell assembly 15.

Figure 2:
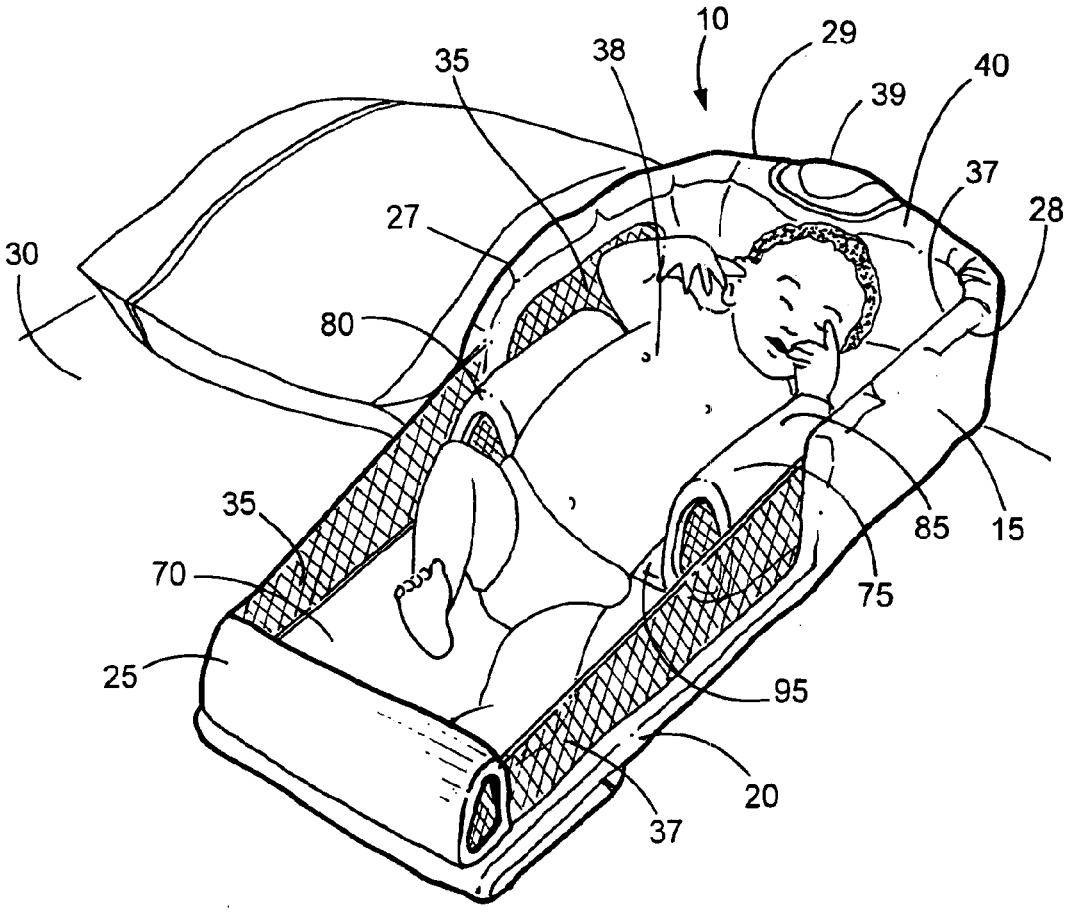
FIG. 2 is a perspective view of the infant sleep positioner of FIG. 1, holding an infant.

As shown in FIG. 2, the infant sleep positioner 10 is positioned on the bed 30 and an infant 38 is placed within the sleep space in a supine position within the sleep space of the infant sleep postioner 10.

Figure 3:
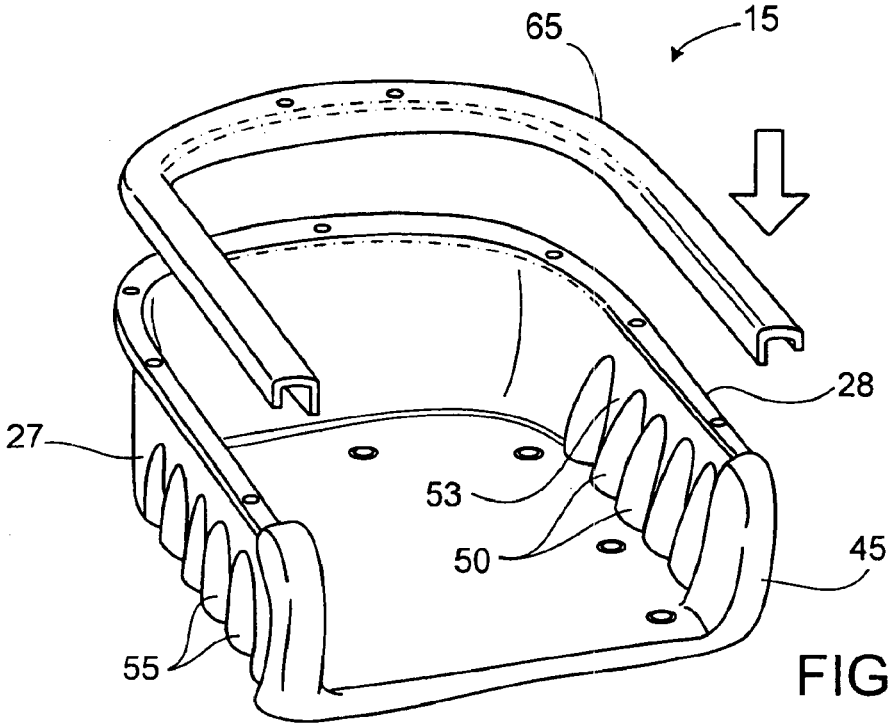
FIG. 3 is a partially exploded view of various components of the infant sleep positioner of FIG. 1.

Referring now to FIGS. 1 and 3, the shell assembly 15 includes a fabric layer 40 covering a basin core 45. Between the fabric layer 40 and the basin core 45, a layer of batting material (not shown) may be provided to impart softness to the infant sleep positioner 10. In one embodiment, the basin core 45 is formed from polypropylene and the fabric covering is polyester or a polyester blend. A portion of the basin core 45 includes a plurality of ridges or standoffs 50 and a plurality of recess regions 53 between the ridges 50. In one embodiment, a plurality of apertures 55 are located within the recess regions 53 to permit airflow through left and right walls 27, 28 of the shell assembly 15. In an embodiment, the mesh side walls 57, 59 (FIG. 1) overlay the ridges 50 to inhibit the infant 38 from contacting the recessed regions 53 between the ridges 50 and affecting normal breathing.

Preferably, as shown in FIG. 3, a top rim 65 steps the mesh side walls 57, 59 away from the standoffs 50 of the left and right shell walls 27, 28 to define a plurality of interstitial spaces 60. If the infant 38 should roll over and position his or her face proximate to the left or right side walls 27, 28, mesh side walls 57, 59 prevent the infant 38 from covering the apertures 55 and the air flow to the infant and the sleep space is not compromised. A removable mattress 70 is provided in one embodiment to fit within the sleep space and provide additional comfort to infant 39 (FIG. 2).

In one embodiment, a positioner insert 75 is removably located within the sleep space to provide additional stability to the infant 38 occupant. The insert 75 includes left and right nacelles 80, 85 each having an extension tab 90, 95 extending horizontally therefrom. The extension tabs 90, 95 are removably attached together to define a desirable distance between the nacelles 80, 85 generally corresponding to the width of the infant. In one embodiment, the nacelle 80, 85 are hollow cylindrical or polygonal elements and include mesh ends 90, 95 at both ends of the nacelles to permit air flow therethrough.

Figure 4:
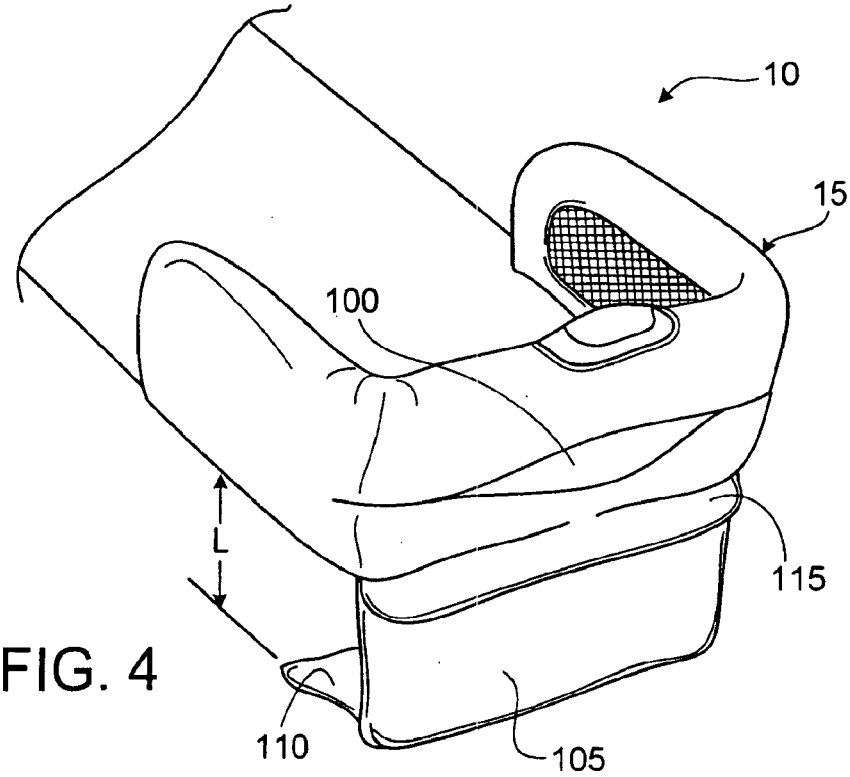
FIG. 4 is a rear perspective view of the infant sleep positioner of FIG. 1.

Referring now to the embodiment of FIG. 4, the fabric layer 40 contains a zippered opening 100 in the back of the infant sleep positioner 10 for receiving the basin core 45. An anchoring flap 105 is shown flexibly attached to a lower portion of the rear wall 29. In further embodiments, an anchoring extension 110 is flexibly attached to the anchoring extension 105. In one embodiment, the anchoring flap 105 is removably attached to the rear wall 29 at a tab 115 with hook and loop type fasteners to permit the adjustment of length L to accommodate mattresses 30 of varying heights as will be described below. Either the anchoring flap 105 or the anchoring extension 110 may include a masonite panel for additional rigidity.

Figure 5:
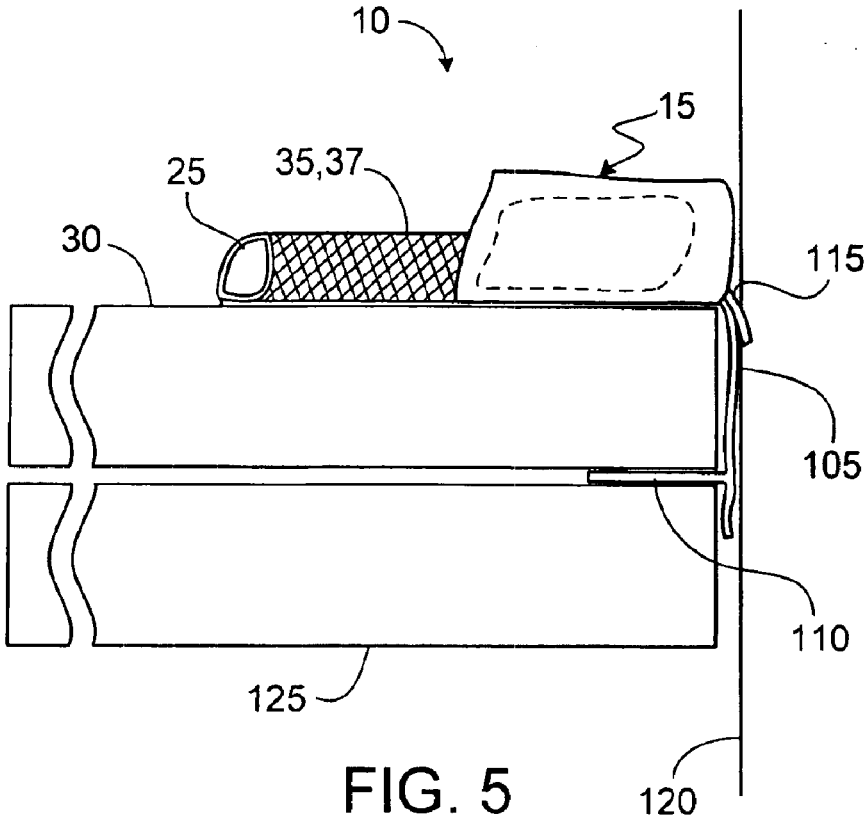
FIG. 5 is a side view of the infant sleep positioner of FIG. 1 installed on a bed.

Referring now to the embodiment of FIG. 5, the infant sleep positioner 10 is installed atop a mattress 30 with the anchoring flap 105 positioned between the mattress 30 and a wall, headboard or footboard 120 and the anchoring extension 110 is positioned between the mattress 30 and a foundation 125. In one embodiment, the length of the anchoring flap 105 is adjusted by disengaging the hook and loop fasteners holding the flap 105 to the tab 115 and reapplying the anchoring flap 105 to the tab 115 such that the anchoring extension 110 extends to the gap between the mattress 30 and the foundation 125. Tucking the anchoring extension 110 between the mattress 30 and foundation 125 and/or securing the anchoring flap 105 securely between the mattress 30 and the wall, headboard or footboard 120 minimizes lateral movement of the infant sleep positioner 10 when positioned on the bed.

Referring now to FIG. 6, the infant sleep positioner 10 is folded into a stowed state for storage or transport. After removing or moving the positioner insert 75 to the shell assembly 15, the base 20 is rolled over the top of the shell assembly 15 and a folding flap 130 is rolled up for releaseable attachment to the back of the rear wall 29 in the direction of arrow 135. The anchoring flap 105 is folded toward the bottom of the shell assembly 15 for releaseable attachment thereto with hook and loop fasteners, for example. A handle 150 is provided in one embodiment for carrying.

A number of embodiments of the invention have been described. Nevertheless, it will be understood that various modifications may be made without departing from the spirit and scope of the invention. For example, the shell assembly 15 may be configured in a tapered or frusto-conical shape, such that the left and right walls 27, 28 converge at an upper portion and the need for the rear wall 29 is obviated. Accordingly, other embodiments are within the scope of the following claims.

What is claimed is:

1. A device for stabilizing the position of an infant while sleeping, the device comprising:

a substantially rigid basin assembly having three sides and defining an opening and a planar base extending through the opening; and a basin cover having a fabric outer surface and conforming generally to the basin and defining a sleep space, sized and configured for holding an infant;

wherein at least one of the sides of the basin assembly comprises a plurality of standoffs extending into the basin assembly and defining recesses therebetween, the cover having an air-permeable section overlaying the recesses to enable pneumatic communication between the sleep space and the recesses.

2. The device of claim 1 wherein the recesses further comprise apertures to improve pneumatic communication between the sleep space and the recesses.

3. The device of claim 1 further comprising a foam foot stop removably attached to a lower portion of the planar base.

4. The device of claim 3 further comprising left and right side netting walls extending from the basin to the foot stop along both sides of the planar base for providing supplemental security to the infant occupant.

5. The device of claim 1 where the device is adapted to be foldable into a stowed state.

6. The device of claim 5 further comprising a storage flap depending from a front portion of the planar base and releaseably attached to a bottom surface thereof, wherein the storage flap in unfurled and extends over the basin assembly in the stowed state.

7. The device of claim 1 further comprising an anchoring flap depending from adjacent the head end of the basin assembly for engagement between a mattress and a wall.

8. The device of claim 7 wherein the anchoring flap comprises masonite.

9. The device of claim 1 further comprising an adjustable insert releasably attached to the planar base and comprising two soft nacelles, each nacelle having releasably attached tabs extending therefrom for separating the nacelles a distance substantially equal the width of an infant.

10. The device of claim 1 wherein the basin assembly further comprising a built-in night light.

11. The device of claim 1 further comprising an anchoring flap flexible depending adjacent to a head end of the basin assembly, the anchoring flap sized and positioned for insertion between the bed and a solid surface to limit lateral movement of the device.

12. The device of claim 11 further comprising an extension flap connected to the anchoring flap and extending substantially parallel to the planar base, wherein the extension flap is sized and positioned for insertion between the mattress and foundation of a bed for stabilizing the movement of the device.

13. A device for stabilizing the position of an infant while sleeping, the device comprising:

a substantially rigid three-sided basin assembly defining an opening and being sized and configured for holding the infant wherein at least a portion of the sides of the basin assembly comprise a plurality of standoffs having recesses which define opening;

a planar base extending from the basin assembly;

a perforated layer overlaying the standoffs to prevent the infant from contacting the recesses along the sides of the basin assembly;

a foam foot stop removably attached to a lower portion of the planar base; and left and right side netting walls extending from the basin assembly to the foot stop along both side of the planar base for providing supplemental security to the infant occupant.

14. The device of claim 13 wherein the device is adapted to be foldable in a stowed state.

15. The device of claim 13 further comprising a night light integrally molded to the basin assembly.

* * * * *